US005607896A

United States Patent [19]

Hutt

[11] Patent Number: 5,607,896

[45] Date of Patent: Mar. 4, 1997

[54] THERMAL TRANSFER PRINTING DYESHEET

[75] Inventor: Kenneth W. Hutt, Essex, England

[73] Assignee: Imperial Chemical Industries PLC, London, England

[21] Appl. No.: 418,163

[22] Filed: Apr. 6, 1995

Related U.S. Application Data

[63] Continuation of Ser. No. 932,481, Aug. 20, 1992, abandoned.

[30] Foreign Application Priority Data

Aug. 20, 1991 [GB] United Kingdom ..... 9117986

[51] Int. Cl.[6] ..... B41M 5/035; B41M 5/38

[52] U.S. Cl. ..... 503/227; 428/195; 428/913; 428/914; 430/200; 430/201; 430/945

[58] Field of Search ..... 8/471; 428/195, 428/913, 914; 503/227; 430/200, 201, 945

[56] References Cited

U.S. PATENT DOCUMENTS

| | | | |
|---|---|---|---|
| 4,695,288 | 9/1987 | Ducharme | 8/471 |
| 4,716,144 | 12/1987 | Vanier et al. | 503/227 |
| 4,788,128 | 11/1988 | Barlow | 430/200 |
| 5,070,069 | 12/1991 | Bradbury et al. | 503/227 |
| 5,104,847 | 4/1992 | Hann et al. | 503/227 |
| 5,147,843 | 9/1992 | Bodem et al. | 503/227 |

FOREIGN PATENT DOCUMENTS

| | | | |
|---|---|---|---|
| 60-232996 | 11/1985 | Japan | 503/227 |
| 63-082792 | 4/1988 | Japan | 503/227 |
| 63-281888 | 11/1988 | Japan | 503/227 |
| 2083726 | 3/1982 | United Kingdom | 503/227 |

*Primary Examiner*—B. Hamilton Hess
*Attorney, Agent, or Firm*—Cushman Darby & Cushman IP Group Pillsbury Madison & Sutro LLP

[57] ABSTRACT

A dyesheet for light-induced thermal transfer printing comprises a substrate having on one side a dyecoat comprising a first polymeric binder containing at least one thermal transfer dye dissolved or dispersed therein, and between the dyecoat and the substrate an absorber coat comprising a polymeric material through which the dye molecules diffuse less readily under printing conditions than they do through the dyecoat binder.

21 Claims, No Drawings

THERMAL TRANSFER PRINTING DYESHEET

This is a continuation of application Ser. No. 07/932,481, filed on Aug. 20, 1992, which was abandoned.

The invention relates to light-induced thermal transfer printing, and in particular to dyesheets therefor.

Thermal transfer printing is a process for generating images by transferring dyes from a dyesheet to a receiver by application of heat. Such dyesheets comprise a substrate, usually a thin polymer film, coated on one side with a dyecoat containing one or more thermally transferable dyes. Printing is effected while holding the dyecoat against a receiver surface, and selected areas of the dyesheet are heated so as to transfer the dyes from those areas to the adjacent corresponding areas of the receiver, thereby generating the images according to the areas selected. Complex images can be built up from large numbers of very small pixels placed close together, and the resolution of the final image is determined by the number, size and spacing of such pixels.

Light-induced thermal transfer printers have a light source which can be focused on each area to be heated, in turn. Usually it is the light from such source that is caused to scan all the required areas on a stationary dyesheet, but in principle there is no reason why the dyesheet should not be caused to move in front of a stationary modulated light beam. By programming the printer to respond to electronic signals representing monochrome or full colour images (e.g. from a video, electronic still camera or computer), hard copies of those images can be produced. The inducing light is usually selected to have a narrow wave band, which can be in the visible, ultra violet or infra-red regions, as such narrow wavebands can be finely focused more readily, and good laser sources of various wavelengths are available. Infra-red emitting lasers are particularly suitable. However, sources of much broader wavebands can be used for some applications.

To convert the inducing light into thermal energy for effecting transfer of the dye, the dyesheet contains a material which is an absorber for that light. This converts the light into heat at the point at which the light is incident, transferring dye molecules adjacent to that point to produce a single pixel at the corresponding position in the receiver. Where such dyesheets had the absorber material in the dyecoat itself, this minimised any loss of the generated heat between the absorber and dye molecules during printing, thereby maximising sensitivity.

Absorber materials need to be selected according to the light source it is proposed to use, and various absorbers have been used or proposed, including for example dyes of a complementary colour to the inducing light, or a solid particulate material such as carbon black, which can absorb a broad spectrum of wavelengths. However, when such dyes are visibly coloured, and these or particulate absorbers such as carbon black, are located in the dyecoat itself, there is a danger that some may be carried over to the receiver during printing, to produce visible markings and thus detract from the print quality.

This has previously been recognised (e.g. as described in GB 2,083,726), and a generally preferred format is to secure the absorber in a further layer of the binder between the dyecoat and the substrate. Although this does remove the heat-generating source from its previous intimate mixture with the dyes to be transferred, it was found that the dyecoat, by providing a barrier layer over the absorber, could be effective in preventing transfer of the latter to the receiver.

Unfortunately, this usually resulted in producing prints of noticeably lower optical density than those made with dyesheets in which the absorber is incorporated into the dyecoat, and such dyesheets were described as being less sensitive than the singly coated sheets. We have now found that the disadvantage of lower sensitivity can be reduced by using different binders for the two layers, where these binders are selected for their relatively different properties.

According to the present invention, a dyesheet for use in light-induced thermal transfer printing wherein inducing light is absorbed to provide the thermal energy required for effecting transfer of dye from the dyesheet to a receiver, comprises a substrate having on one side a dyecoat comprising a polymeric binder containing at least one thermal transfer dye dissolved or dispersed therein, and between the dyecoat and the substrate an absorber coat comprising a material which is an absorber for the inducing light to convert it into the required thermal energy, characterised in that the absorber coat comprises a polymeric material which is different from that of the dyecoat binder and through which the dye molecules diffuse less readily under printing conditions than they do through the dyecoat binder.

Whereas the polymeric material of the absorber coat may itself inherently absorb or be adapted to absorb the inducing light (e.g. by having an absorber chemically attached to it), we generally prefer that such polymeric material comprises a polymeric binder in which the absorber is dissolved or dispersed. This enables both the absorber and the polymeric material to be selected independently for the task each has to perform. We prefer that the dyecoat binder and the absorber coat binder (being different in the present invention) are both substantially transparent to the inducing light used for printing.

During printing, the heated dye molecules diffuse readily through the dyecoat binder to reach the receiver against which it is held. Large scale movement in the reverse direction, however, appears to be resisted by the present absorber coat, but whatever the mechanism involved, more of the dye is caused to travel towards the receiver. The observable practical effect is that the maximum achievable optical density is greater when using two such different binders according to the invention, than when using the same binders for both the absorber coat and dyecoat according to previous practices. At lower energy levels, the measured optical density of a print might be slightly less, but we have found any such reduction to be less noticeable to one viewing the print than the improvement gained due to the enhanced maximum achievable optical density that can be obtained using the present dyesheets.

One way of putting the present invention into practice, is to use for the absorber coat a composition which is chemically less compatible with the dyes than is the dyecoat binder. This causes dyes preferentially to travel towards the receiver during printing. Polymer compositions which generally have a low compatibility with thermal transfer dyes, include those which are more hydrophilic. Examples which contrast with polymers more commonly used for dyecoat binders, include vinyl alcohol/vinyl acetate copolymers, polyvinyl pyrrolidone, polyacrylic acid and water soluble celluloses.

An alternative is to make diffusion through the absorber coat physically more difficult, by using for that binder, a polymer composition which is more highly crosslinked than the polymeric binder of the dyecoat. Indeed, our preferred dyesheet is one in which the absorber coat comprises a highly crosslinked organic polymer; and thus contrasts with normal dyecoat binders which are substantially uncrosslinked polymeric materials and thus readily permeable to the dye molecules. Highly crosslinked polymeric layers can be obtained as the reaction products of curing a layer of coating composition comprising a mixture of a reactive resin and a crosslinking agent having a plurality of functional groups reactive with the resin. Examples include epoxy resins, polyurethanes, and base or acid catalysed condensation reaction products, especially the latter.

Thus a preferred crosslinked material is the reaction product of a solvent-soluble compound having a plurality of reactive hydroxyl groups per molecule, and a crosslinking agent reactive with such hydroxyl groups, the functionality of one of these reactants being at least 2, and the functionality of the other being at least 3, thereby to produce a highly crosslinked polymer matrix.

Solvent-soluble polymeric compounds suitable for crosslinking as above include polyacrylic acid, polyvinylbutanol and terpolymers of vinyl acetate, vinyl chloride and vinyl alcohol, e.g. VROH terpolymers (Union Carbide). Suitable solvents for these have some polarity, but solvents should be chosen which are also solvents for the crosslinking agent. Examples of generally useful solvents include acetone, diacetone alcohol (DAA) and isopropanol. The solvent-soluble compounds may also be selected from low molecular weight compounds such as polyalkylene glycols having terminal hydroxyl groups, e.g. polypropylene glycol and diethylene glycol.

Preferred crosslinking agents are polyfunctional N-(alkoxymethyl) amine resins having at least three alkoxymethyl groups per molecule which are available to react with the hydroxyl groups of the above solvent-soluble compounds. Such crosslinking agents include alkoxymethyl derivatives of urea, guanamine and melamine resins. Lower alkyl compounds (i.e. up to the butoxy derivatives) are available commercially and all can be used effectively, but the methoxy derivative is much preferred because of the greater ease with which its more volatile by-product (methanol) can be removed afterwards.

Examples of the latter which are sold by American Cyanamid in different grades under the trade name Cymel, are the hexamethoxymethylmelamines, suitably used in a partially prepolymerised (oligomer) form to obtain appropriate viscosities. Hexamethoxymethylmelamines are 3–6 functional, depending on the steric hindrance from substituents, and are capable of forming highly crosslinked materials using suitable acid catalysts, e.g. p-toluene sulphonic acid (PTSA). However, the acids are preferably blocked when first added, to extend the shelf life of the coating composition. Examples include amine-blocked PTSA (e.g. Nacure 2530) and ammonium tosylate.

Other highly crosslinked materials which can be used for the absorber layer binder include crosslinked reaction products of polymerising at least one organic compound having a plurality of radically polymerisable unsaturated groups per molecule. The absorber itself is dissolved or dispersed in the coating composition before the composition is applied to the substrate, and remains held in the resulting layer on curing.

Our preferred absorber coat by this route comprises the reaction product of radically polymerising a layer of coating composition having the following constituents:

a) at least one organic compound having a plurality of radically polymerisable unsaturated groups per molecule, and at least one of b and c wherein b) consists of at least one organic compound having a single radically polymerisable unsaturated group per molecule copolymerisable with a, and c) consists of at least one linear organic polymer in amount within the range 1–20% by weight of the total amount of the radically polymerisable compounds of constituents a and b.

When the radically polymerisable groups have been copolymerised, the polyfunctional materials provide the binder with improving resistance to diffusion by the dye as the number of unsaturated groups per molecule increases, but this is at the expense of flexibility. It is to mitigate this lack of flexibility that we add the monofunctional comonomers and/or the linear polymer. However, we still prefer to restrict the bulk (at least 95% by weight) of our polyfunctional constituent a to compounds with only 2–8, preferably 2–6, radically polymerisable unsaturated groups per molecule.

Examples of polyfunctional compounds having just two radically polymerisable unsaturated groups per molecule and suitable for use as or as part of constituent a of this composition, include 1,6-hexandiol di(meth)acrylate (the designation "(meth)" being used herein to indicate that the methyl group is optional, i.e. referring here to both 1,6-hexandiol dimethacrylate and 1,6-hexandiol diacrylate), ethylene glycol di(meth)acrylate, diethylene glycol di(meth)acrylate, triethyleneglycol di(meth)acrylate, tetraethylene glycol di(meth)acrylate, polyethylene glycol di(meth)acrylate, tripropylene glycol di(meth)acrylate, polypropylene glycol di(meth)acrylate, and neopentyl glycol di(meth)acrylate.

Examples of compounds having three or more radically polymerisable groups and suitable for use as or as part of constituent a include trimethylol propane tri(meth)acrylate, pentaerythritol tri(meth)acrylate, pentaerithritol tetra(meth)acrylate, and dipentaerythritol hexa(meth)acrylate. Other examples include compounds having three or more radically polymerisable groups corresponding to the difunctional compounds above, including esters of (meth-)acrylic acid with polyester polyols and polyether polyols which are obtainable from a polybasic acid and a polyfunctional alcohol, urethane (meth)acrylates obtained through a reaction of a polyisocyanate and an acrylate having a hydroxy group, and epoxy acrylates obtained through a reaction of an epoxy compound with acrylic acid, an acrylate having a hydroxy group or an acrylate having a carboxyl group.

Examples of monofunctional compounds suitable for use in constituent b, i.e. compounds having a single radically polymerisable unsaturated group per molecule, include such aliphatic (meth)acrylates as 2-ethylhexyl (meth)acrylate and lauryl (meth)acrylate, such alicyclic (meth)acrylates as cyclohexyl (meth)acrylate, isobornyl (meth)acrylate, dicyclopentanyl (meth)acrylate, and dicyclopentadienyl (meth-)acrylate, such alkoxyalkylene glycol (meth)acrylates as methoxydiethylene glycol acrylate, and ethoxydiethylene glycol acrylate, such aromatic (meth)acrylates as phenyl acrylate, and benzyl acrylate, and such (meth)acrylates of aliphatic alcohols as 2-hydroxyethyl (meth)acrylate, and 2-hydroxyethyl di(meth)acrylate. Of these, compounds having at least one alicyclic group per molecule are particularly favoured because of their low shrinkage characteristics. We also find that they can provide a surprising degree of resistance to migration of the dye from dyecoat to absorber coat during storage.

Where an organic compound having a single radically polymerisable unsaturated group per molecule, i.e. constituent b, is present, we prefer to have an excess of constituent a over constituent b to maintain a high resistance to dye diffusion therethrough, our preferred composition having the polymerisable constituents a and b in the proportions 50–90% of a and correspondingly 50–10% of b, by weight.

Preferred linear polymers of constituent c are polymethyl methacrylate, polyvinyl chloride, linear polyesters and acrylated polyester polyols. Examples include Diakon LG156 polymethylmethacrylate and Corvic CL440 vinyl chloride/vinyl acetate copolymer (both from ICI plc), Ebecryl 436 linear polyester (supplied as a 40% solution trimethylolpropane triacrylate by UCB) and Synacure 861X hydroxyfunctional acrylated polyester. All of these consist of linear molecules essentially free from functional acrylic groups, and are believed to remain entwined in the crosslinked matrix but not chemically bonded to it.

In order to make such a crosslinked absorber coat, a coating composition of the absorber dissolved or dispersed within the solution containing the polymerisable moleties, is applied as a layer onto the the substrate and any solvent removed by drying. The resultant dry layer is then cured by heating or by irradiating with electromagnetic (e.g. ultraviolet) radiation. In addition to the above mentioned radically polymerisable compounds, this coating composition includes solvents and radical polymerisation initiators, as required to complete.

Suitable solvents include alcohols, ketones, esters, aromatic hydrocarbons, and halogenatated hydrocarbons. The quantity of solvent required is that which provides a solution viscosity having good coating characteristics.

Examples of suitable radical polymerisation initiators, include benzophenone, benzoin, such benzoin ethers as benzoin methyl ether and benzoin ethyl ether, such benzyl ketals as benzyl dimethyl ketal, such acetophenones as diethoxy acetophenone and 2-hydroxy-2-methyl propiophenone, such thioxanthones as 2-chloro-thioxanthones and isopropyl-thioxanthone, such anthraquinones as 2-ethyl-anthraquinone and methylanthraquinone (the above normally being in the presence of an appropriate amine, e.g. Quantacure ITX (a thioxanthone) in the presence of Quantacute EPD (an aromatic amine), both from Ward Blenkinsop), such azo compounds as azobisisobutyronitrile, such organic peroxides as benzoly peroxide, lauryl peroxide, di-t-butyl peroxide, and cumyl peroxide. Other examples of commercially available systems include Igacure 907 from Ciba Geigy, and Uvecryl P101 from UCB. The quantity of these radical polymerisation initiators used in the polymerisation is 0.01–15% by weight of the aforementioned radically polymerisable compounds.

Other additives may also be incorporated into the coating solution, to improve further its coating characteristics, for example.

Various coating methods may be employed, including, for example, roll coating, gravure coating, screen coating and fountain coating. After removal of any solvent, the coating can be cured by heating or by irradiating with electromagnetic radiation, such as ultraviolet light, electron beams and gamma rays, as appropriate. Typical curing conditions are heating at 50°–150° C. for 0.5–10 minutes (in the case of thermal curing), or exposure to radiation for 1–60 s from an ultraviolet lamp of 80 W/cm power output, positioned about 15 cm from the coating surface (in case of ultraviolet light curing). In-line UV curing may utilise a higher powered lamp, e.g. up to 120 W/cm power output, focused on the coating as it passes the lamp in about 0.1–10 ms. The coating is preferably applied with a thickness such that after drying and curing the thickness is 0.1–5 μm, preferably 0.2–3 μm, and will depend on the concentration of the coating composition.

Our preferred absorber is carbon black, as this provides good absorption and conversion to heat, of a broad spectrum of wavelengths, and hence is not critical to the inducing light source employed for the printing. Particulate graphite can similarly be used as a broad band absorber.

For lasers operating in the near infra-red, there are a number of organic materials known to absorb at the laser wavelengths. Examples of such materials include the substituted phthalocyanines described in EP-B-157,568, which can readily be selected to match laser diode radiation at 750–900 nm, for example.

Also of importance is the provision of sufficient absorber for the system used. It is desirable to use sufficient to absorb at least 50% of the incident inducing light. We prefer to use sufficient to absorb at least 90% of the inducing light, to obtain an optical density of 1 in transmission, although higher proportions may be used if desired.

A variety of materials can be used for the substrate, including transparent polymer films of polyesters, polyamides, polyimides, polycarbonates, polysulphones, polypropylene and cellophane, for example. Biaxially orientated polyester film is the most preferred, in view of its mechanical strength, dimensional stability and heat resistance. The thickness of the substrate is suitably 1–50 μm, and preferably 2–30 μm.

The dyecoat is formed by coating the absorber coat with an ink prepared by dissolving or dispersing one or more thermal transfer dyes and a binder resin to form a coating composition; then removing any volatile liquids. Any dye capable of being thermally transferred in the manner described above, may be selected as required. Dyes known to thermally transfer, come from a variety of dye classes, e.g. from such nonionic dyes as azo dyes, anthraquinone dyes, azomethine dyes, methine dyes, indoaniline dyes, naphthoquinone dyes, quinophthalone dyes and nitro dyes. The dyecoat binder can be selected from such known polymers as polycarbonate, polyvinylbutyral, and cellulose polymers, such as methyl cellulose, ethyl cellulose and ethyl hydroxyethyl cellulose, for example, and mixtures of these. A preferred dyecoat is one comprising one or more thermally transferable dyes dispersed throughout a polymeric binder comprising a mixture of polyvinylbutyral and cellulosic polymer, wherein the percentage by weight of polyvinylbutyral in the mixture lies within the range 65–85%, the range 70–85% being particularly preferred.

The ink may also include dispersing agents, antistatic agents, antifoaming agents, and oxidation inhibitors, and can be coated onto the absorber layer as described for the formation of the latter. The thickness of the dyecoat is suitably 0.1–5 μm, preferably 0.5–3 μm.

The dyesheet may be elongated in the form of a ribbon and housed in a cassette for convenience, enabling it to be wound on to expose fresh areas of the dyecoat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels are suitably in the form of transverse panels, each the size of the desired print, and arranged in a repeated sequence of the colours employed. During printing, panels of each colour in turn are held against a dye-receptive surface of the receiver sheet, as the two sheets are imagewise selectively irradiated to transfer the dye selectively where required, the first colour being overprinted by each subsequent colour in turn to make up the full colour image.

Although the present invention provides specific absorber coats to provide a barrier through which the dye molecules diffuse less readily under printing conditions, such barrier absorber coats can be advantageous for both dye diffusion printing and sublimation printing. The former can be procured by bringing the dyecoat and receiver surfaces into intimate contact, so that the dye molecules can diffuse directly from the dyecoat into the receiver. For maximised optical densities we prefer that for each of these surfaces the average roughness shall be less than 0.2 μm, especially less than 0.15 μm (the average roughness being the arithmetic average of all departures of the roughness profile from a centre line). For such smooth surfaces, pressures of about 1 atmosphere are then sufficient to provide intimate contact between the surfaces.

Sublimation printing occurs in the vapour phase, and hence requires a small air gap between the surfaces to enable the dye molecules to sublime across. This can be useful for printing rough receivers with sublimable dyes, and indeed it has previously been proposed to add small spacer particles for light-induced transfer processes, as described for example in U.S. Pat No. 4,876,235. However, we have found that further heating steps may be desireable to enable the dyes to penetrate the receiver and be less prone to removal by wiping.

Thus generally we prefer that the thermal transfer conditions are such as to procure transfer by dye diffusion. Accordingly, a further aspect of the invention provides a process of light-induced thermal transfer printing characterised in that the dyesheet and receiver are provided with smooth surfaces which are pressed into intimate contact during printing whereby the dye molecules can diffuse directly from the dyecoat into the receiver when heated.

The invention will now be illustrated by specific examples of dyesheets prepared according to the invention, reference also being made to other dyesheets prepared for comparative purposes.

EXAMPLE 1 AND COMPARATIVE EXAMPLES C1–3

A series of four dyesheets was prepared using various permutations of a crosslinked absorber coat, an uncrosslinked absorber coat, an uncrosslinked dyecoat and a crosslinked dyecoat. The same polymers were used for both the dyecoat and absorber coat binders throughout, these being a mixture of polyvinylbutyral ("PVB"—grade BX-1 from Hercules being used) and ethyl cellulose ("EC"—grade T10 from Sekisui being used). In the crosslinked coatings a crosslinking agent and catalyst were also added, these being a hexamethoxymethylmelamine oligomer (Cymel 303 from American Cyanamid) and an amine-blocked p-toluene sulphonic acid ("PTSA") respectively. The infra-red absorber used in this series was a substituted phthalocyanine dye. The coating compositions were as follows:

| Absorber coat A: crosslinked. | |
|---|---|
| infra-red absorber | 0.31 g |
| PVB | 1.00 g |
| EC | 0.25 g |
| Cymel 303 | 1.53 g |
| PTSA | 0.03 g |
| THF | 37.50 g |

The PTSA catalyst was added to the solution just before coating. The catalysed composition was then spread onto a transparent substrate by a No 2 meyer K-bar to give a 12 μm wet layer, and dried to give an approximately 1 μm dry coat. This was then cured by placing it in an oven at 140° C. for 3 minutes.

| Absorber coat B: uncrosslinked. | |
|---|---|
| Infra-red absorber | 0.28 g |
| PVB | 2.00 g |
| EC | 0.50 g |
| THF | 30.58 g |

This was similarly applied with a No 2 meyer K-bar to give a 12 μm wet coat and an approximately 1 μm dry coat.

| Dyecoat C: uncrosslinked. | |
|---|---|
| thermal transfer dye 1 | 0.86 g |
| thermal transfer dye 2 | 0.21 g |
| PVB | 0.95 g |
| EC | 0.24 g |
| THF | 24.74 g |

where thermal transfer dye 1 was CI Disperse Red 60, and thermal transfer dye 2 was 3-methyl-4-(3-methyl-4-cyanoisothiazol-5-ylazo)-N-ethyl-N-acetoxyethylaniline.

This composition was applied over an absorber coat using a No 3 K-bar, to give a 24 μm wet coat, and dried to give an approximately 2 μm dry coat.

| Dyecoat D: crosslinked. | |
|---|---|
| thermal transfer dye 1 | 0.86 g |
| thermal transfer dye 2 | 0.21 g |
| PVB | 1.00 g |
| EC | 0.24 g |
| Cymel 303 | 2.26 g |
| PTSA | 0.05 g |
| THF | 49.89 g |

The PTSA catalyst was added to the solution just before coating. The catalysed composition was then similarly coated onto a previously applied absorber coat, using a No 3 K-bar to give a 24 μm wet layer, and dried to give an approximately 2 μm dry coat. This was then cured by placing it in an oven at 140° C. for 3 minutes.

Dyesheets

Four dyesheets were produced in this manner:

| | |
|---|---|
| Dyesheet 1: | Absorber coat A overlayed with Dyecoat C |
| Dyesheet 2: | Absorber coat B overlayed with Dyecoat C |
| Dyesheet 3: | Absorber coat A overlayed with Dyecoat D |
| Dyesheet 4: | Absorber coat B overlayed with Dyecoat D |

The dyesheets were placed against transparent dye diffusion receivers having smooth receiver coat surfaces of average roughness less than 0.04 μm (being the arithmetic average of all departures of the roughness profile from the centre line within an evaluation length, this being 5.6 mm for the above measurements made using a Perthometer). The dyecoats and adjacent receiver coats were pressed into intimate contact by the application of 1 atmosphere of pressure. An STC LT-100 laser diode operating at 807 nm was collimated and then focused using a 160 mm achromat lens. The incident laser power at the dyesheet was about 60 mW and the laser spot size (full width at half power maxima) was about 30 μm×20 μm.

The laser spot was scanned by a galvanometer scanner. The dyesheet and receiver sheet were held on an arc which allowed focus to be retained throughout the scan length. The scanning equipment addressed the laser to locations 20 μm by 10 μm apart, giving a good overlap of adjoining spots. At each spot the laser was pulsed for a specific time and the optical density of transmitted dye recorded. The results are shown in the table below.

TABLE 1

| | | Transmission optical density | |
|---|---|---|---|
| | | LASER PULSE LENGTH | |
| EXAMPLE | DYESHEET | 200 μs | 500 μs |
| 1 | 1 | 0.19 | 1.56 |
| C1 | 2 | 0.11 | 0.91 |
| C2 | 3 | 0.02 | 0.27 |
| C3 | 4 | 0.02 | 0.13 |

These results show there is a significant advantage to be gained in using dyesheet 1 according to the invention, over dyesheet 2 having uncrosslinked binders of the same composition for both absorber coat and dyecoat, in known manner. Dyesheets 3 and 4, where the dyecoat is a poor dye diffuser, are significantly worse than either of dyesheets 1 and 2.

EXAMPLE 2 AND COMPARATIVE EXAMPLES C4–6

A further series of four dyesheets was prepared using essentially the same permutations of crosslinked and uncrosslinked coats, except that the infra-red absorbing material used was carbon black, instead of the dye. As in the previous Examples, crosslinked and uncrosslinked absorber subcoats were prepared, and used with dyecoat formulations C and D, as specified in the previous Examples.

The absorber coat formulations were as follows:

| Absorber coat E: crosslinked | |
|---|---|
| carbon black dispersion | 31.51 g |
| PVB | 0.88 g |
| EC | 0.21 g |
| Cymel 303 | 1.00 g |
| PTSA | 0.1 g |
| MEK | 86.3 g |

This was spread onto a transparent film using a No 3 meyer K-bar to give a 24 μm wet coat and approximately 2 μm dry coat. This subcoat was cured by placing it in a 140° C. oven for 3 minutes.

| Absorber coat F: uncrosslinked | |
|---|---|
| carbon black dispersion | 31.51 g |
| PVB | 1.75 g |
| EC | 0.44 g |
| MEK | 86.3 g |

This was similarly applied with a No 3 meyer K-bar to give a wet coat thickness of 24 μm and a dry coat thickness of approximately 2 μm.

The carbon black dispersion used in these formulations was prepared by milling carbon black (Monarch 1000 from Cabot Carbon Ltd), dispersing agents (Solsperse 5000 and Solsperse 24000 from ICI), and methyl ethyl ketone (MEK) in a ball mill for 45 minutes. The formulation was:

| | |
|---|---|
| carbon black | 6.25 g |
| dispersing agent (Solsperse 5000) | 0.52 g |
| dispersing agent (Solsperse 24000) | 1.04 g |
| MEK | 23.70 g |

Dyesheets

Four dyesheets were produced as follows:

| | |
|---|---|
| Dyesheet 5: | Absorber coat E overlayed with Dyecoat C |
| 6: | Absorber coat F overlayed with Dyecoat C |
| 7: | Absorber coat E overlayed with Dyecoat D |
| 8: | Absorber coat F overlayed with Dyecoat D |

Printing with these dyesheets was carried out at two energy levels as described in Example 1. The optical densities of dye transferred from each dyesheet in turn were measured, and gave the following results:

TABLE 2

| | | Transmission optical density | |
|---|---|---|---|
| | | LASER PULSE LENGTH | |
| EXAMPLE | DYESHEET | 200 μs | 500 μs |
| 2 | 5 | 0.29 | 1.74 |
| C4 | 6 | 0.27 | 1.07 |
| C5 | 7 | 0.08 | 0.45 |
| C6 | 8 | 0.04 | 0.22 |

These results reinforce the results obtained with the previous series of Examples, and again show that a significant advantage can be obtained by using dyesheet 5 according to the present invention, rather than dyesheet 6 having uncrosslinked binders of the same composition for both absorber coat and dyecoat, as had previously been taught in the literature. These results also confirm the futility of crosslinking the dyecoat, even when the underlying absorber coat is also similarly crosslinked.

EXAMPLES 3–5 AND COMPARATIVE EXAMPLE C7

This is a further series of Examples to illustrate the use of alternative binders for the absorber coat, and of an alternative absorber. They all use the same dyecoat, this being different from that of the previous Examples. The comparative Example is provided as a control, being essentially as Example 3 but without the absorber binder being crosslinked in the manner of the present invention.

Absorber coat F

A carbon black dispersion was prepared by milling the following mixture for 15 minutes in a sand mill equipped with zirconium oxide beads, except for the PTSA catalyst, which was added just before coating:

| | |
|---|---|
| carbon black (SP250 from Degussa) | 20 g |
| cellulose acetate phthalate (from Eastman Kodak.) | 40 g |
| dispersing agent (Dowanol PM) | 180 g |
| MEK | 125 g |
| Methanol | 75 g |
| Cymel 303 | 4 g |
| PTSA | 2 g |

This dispersion was coated onto 23 μm Melinex filled rade of polyester film (the filler being non-absorbing) using a No 2 meyer bar laying down a dry coat thickness of 1 μm and an optical density at 807 nm of 0.8. This coating was then heated at 110° C. for mins to effect curing of the polymeric binder in the coating.

Absorber coat G

A carbon black dispersion was prepared as described for absorber coat F, except that the cross-linking agent and catalyst were omitted, the formulation thus being:

| | |
|---|---|
| carbon black (SP250 from Degussa) | 20 g |
| cellulose acetate phthalate (from Eastman Kodak.) | 40 g |
| dispersing agent (Dowanol PM) | 180 g |
| MEK | 125 g |
| Methanol | 75 g. |

This was similarly coated onto a polyester film substrate and dried in the manner of Absorber coat F, to give an absorber coating containing a slightly higher proportion of absorber but without the cross-linking of the binder polymer.

Absorber coat H

This is an absorber coat having a hydrophilic binder of polyvinylalcohol (PVA) in which the absorber, carbon black was dispersed, the formulation being:

| | |
|---|---|
| carbon black (E125 from Cabot) | 17 g |
| PVA (from Aldrich) | 34 g |
| water | 450 g |

The polyvinylalcohol was swelled and then dissolved in the distilled water at 60° C. The carbon black absorber was then added to the solution, and the mixture milled (sand mill as above) for 15 minutes, giving a dispersion of carbon black with 90% of particles of size <0.3 μm. This dispersion was coated onto 23 μm filled rade Melinex using a No.2 meyer bar to give a dry coat thickness of 1 μm. The coating was dried at 110 ° C. for 5 minutes.

Absorber coat I

This illustrates the use of an absorber layer having as binder a highly cross-linked radically polymerised binder in which the absorber, raphite, was dispersed. The formulation was:

| | |
|---|---|
| graphite/EC dispersion in ethanol - 23% solids (DAG 580 from Acheson Colloids) | 50 g |
| hexafunctional urethane acrylate (Ebercryl 5129 from Radcure) | 13 g |
| Egacure 907 | 0.52 g |
| Uvecryl P115 | 0.52 g. |

This mixture was diluted to 15% by addition of more ethanol (144 g) and coated onto 23 μm filled rade Melinex to a dry coat thickness of 1.5 μm. The coating was dried and then UV cured using a Primarc Minicure machine with lamps set at 0.2 J $cm^{-2}$, the sample being exposed twice for 2 s.

Dyecoat J

A dyecoat coating composition was prepared with the following formulation:

| | |
|---|---|
| Magenta dye | 0.833 g |
| PVB (BX1) | 0.444 g |
| EC (T10) | 0.111 g |
| THF | 11.1 g |

wherein the magenta dye was 3-methyl-4-(3-methyl-4-cyanoisothiazol-5-ylazo)-N-ethyl-N-acetoxyethylaniline.

Each of the above absorber coats (F—I) was then over coated with the Dyecoat J formulation, using a No.2 meyer bar, and dried to give a dry coat thickness of 1.5 μm.

Dyesheets 9–12 thus prepared had a smooth outer surface to their dyecoats, with various average roughness values ranging up to about 0.15 μm, and these were placed against transparent dye diffusion receivers also having smooth surfaces, of average roughness about 0.04 μm. The two smooth surfaces were held in intimate contact by the application of 1 atmosphere pressure in the printing rig of Example 1. Thermal transfer printing was then induced with various laser pulse times as described above, and the optical densities measured in like manner. The laser was the same as that of the previous examples, giving about 60 mW at the dyesheet. The results obtained are shown in the table below.

TABLE 3

| LASER PULSE LENGTH (μs) | Transmission optical density EXAMPLE 3 (F) | C7 (G) | 4 (H) | 5 (I) |
|---|---|---|---|---|
| | ABSORBER COAT | | | |
| 50 | 0.01 | 0.01 | 0.02 | 0 |
| 100 | 0.11 | 0.12 | 0.13 | 0.02 |
| 150 | 0.37 | 0.50 | 0.57 | 0.13 |
| 200 | 0.86 | 0.95 | 1.14 | 0.39 |
| 250 | 1.42 | 1.61 | 1.77 | 0.71 |
| 300 | 1.98 | 2.07 | 2.24 | 1.10 |
| 350 | 2.35 | 2.30 | 2.61 | 1.61 |
| 400 | 2.65 | 2.47 | 2.72 | 2.07 |
| 450 | 2.75 | 2.57 | 2.94 | 2.30 |
| 500 | 2.90 | 2.56 | 3.13 | 2.53 |
| 550 | 2.84 | 2.48 | 3.18 | 2.68 |

Comparison of Examples 3 and C7 show how the barrier effect of the cross-linked absorber binder becomes increasingly noticeable at high OD values. For short laser pulses the OD values are slightly higher for the comparative dyesheet, possibly due in part to its slightly higher absorber concentration. As the pulse lengths increase, the effect of cross-linking the absorber binder becomes increasingly beneficial as the transmitted optical density derived in Example 3 increases faster than that of C7. The subjective effect one notices in a full tone print is a greater richness and improved depth of colour. Example 4 uses the same absorber, and demonstrates how effective can be the use of a simple incompatible resin for the absorber binder.

EXAMPLE 6

In this Example, a further dyesheet (13) was prepared with a highly crosslinked acrylic binder as used in Example 5, but with the graphite absorber replaced by our preferred carbon black. This Example also demonstrates the use of dyesheets of the invention with higher powered lasers.

Absorber coat K

The following formulation was made up and milled in a sand mill (as in previous examples) for 1 hour.:

| | |
|---|---|
| carbon black (Monarch 1000) | 70 g |
| Ebercryl 5129 | 110 g |
| Solsperse 5000 | 10 g |
| Solsperse 24000 | 20 g |
| Toluene | 236 g |

After milling, this mixture was diluted to 15% by further addition of toluene. A catalyst system of

| | |
|---|---|
| Uvecryl 5115 | 0.315 g per 100 g of soln and |
| Ergacure 907 | 0.315 g per 100 g of soln |

was added in amount of 4% w/w on polymer in the above mixture, with stirring. This formulation was then coated onto 23 μm transparent filled rade Melinex to give a dry coat thickness of 1.8 μm using a No.2 meyer bar. The samples were then UV cured with a double application at 170 mJ/cm. The optical density at 807 nm of this coating was measured as 1.3. This was then overcoated with the same magenta dyecoat layer as used in Examples 3–5.

The dyesheet was imaged at varying laser pulse times with an SDL 5422H1 150 mW laser diode and the optical density values obtained are recorded in the table below.

TABLE 4

| LASER PULSE LENGTH (μs) | TRANSMISSION OPTICAL DENSITY |
|---|---|
| 50 | 0.48 |
| 100 | 1.35 |
| 150 | 2.05 |
| 200 | 2.43 |
| 250 | 2.50 |

EXAMPLE 7

This Example is provided to show the effect of one or other of the dyesheet and receiver surfaces having less than ideal smoothness. When dyesheets have undercoats filled with particulate materials it becomes more difficult to obtain a consistent graded roughness series extending to preferred smoothness levels. Accordingly, the effect of varying the roughness is shown below by using a series of receivers of varying roughness with a standard dyesheet, and different dyesheets have been prepared to show how variations in their smoothness can occur, even using the same dyecoat composition for each.

Receivers were prepared as follows:

Receiver 1. This was a standard thermal transfer receiver: a transparent rade of Melinex (ICI plc's polyester film) was coated with a polymer receiver solution, dried and cured.

Receivers 2–5. A substrate of the same rade of Melinex was coated with the same polymeric receiver composition as in Receiver 1, but to which had been added 0.1%, 1%, 5%, and 10% w/w solids of 20 μm glass beads respectively.

Dyesheets were prepared as follows:

A dyecoat coating composition was prepared with the following formulation:

| | |
|---|---|
| Magenta dye | 0.833 g |
| PVB (BX1) | 0.444 g |
| EC (T10) | 0.111 g |
| THF | 11.1 g |

wherein the magenta dye was 3-methyl-4-(3-methyl-4-cyanoisothiazol-5-ylazo)-N-ethyl-N-acetoxyethylaniline. This composition was coated as specified below using a No.2 meyer bar, and dried to give a dry coat thickness of 1.5 μm.

Dyesheet 14. The dyecoat composition was coated onto a 23 μm thick transparent filled rade of Melinex.

Dyesheet 15. The dyecoat composition was hand coated onto a sub-coated 6 μm polyester film which also had a previously applied backcoat.

Dyesheet 16. The dyecoat composition was gravure coated onto a pre-coated 6 μm polyester film like that used in Dyesheet 15.

Dyesheet 17. The dyecoat composition was coated onto an absorber coat of carbon black in a cross-linked binder of UV-cured acrylic polymer, previously coated onto a 23 μm thick transparent filled grade of Melinex.

Roughness measurements were made on the above receiver coats and the dyecoats using a Perthometer. These are expressed below in terms of the average roughness (Ra); defined as the arithmetic average of all departures of the roughness profile from the centre line within the evaluation length. In each case the evaluation length was 5.6 mm. The values given in Table 5 below are the mean values, Ra(m), of the average roughness over 3 traces.

TABLE 5

| Roughness measurements (μm) | Ra(m) |
|---|---|
| Receiver 1 | 0.037 |
| Receiver 2 | 0.064 |
| Receiver 3 | 0.081 |
| Receiver 4 | 0.297 |
| Receiver 5 | 0.595 |
| Dyesheet 14 | 0.086 |
| Dyesheet 15 | 0.292 |
| Dyesheet 16 | 0.298 |
| Dyesheet 17 | 0.119 |

To demonstrate what effect surface roughness might have on a print made by laser induced transfer, all five receivers were printed as described above in Example 1 above, using Dyesheet 17 in each case. The laser pulse time was varied, and the optical density build up measured. The results of this exercise are given in Table 6 below.

It can be seen that as the level of roughness of the receiver surface is increased, the maximum optical density that can be obtained in the receiver is reduced. In addition, we also found that where high levels of roughness are employed in the receiver layer (Receivers 4&5), dye sublimation occurs as indicated by the fact that dye collects as crystals on the surface of the receiver and can be wiped off. This problem becomes particularly noticeable when either of the contacting surfaces has an average roughness above 0.2 μm, and we prefer that both surfaces have roughness values less than 0.15 μm.

TABLE 6

Optical density measurements made in reflection using a Sakura densitometer.

| LASER PULSE TIME | RECEIVER | | | | |
|---|---|---|---|---|---|
| (μs) | 1 | 2 | 3 | 4 | 5 |
| 50 | 0.2 | 0.16 | 0.18 | 0.18 | 0.14 |
| 100 | 0.29 | 0.3 | 0.23 | 0.24 | 0.24 |
| 150 | 0.64 | 0.62 | 0.61 | 0.60 | 0.61 |
| 200 | 1.14 | 1.05 | 1.12 | 1.12 | 1.12 |
| 250 | 1.69 | 1.50 | 1.57 | 1.48 | 1.42 |
| 300 | 2.14 | 1.73 | 1.86 | 1.80 | 1.43 |
| 350 | 2.30 | 2.17 | 2.06 | 1.94 | 1.54 |
| 400 | 2.36 | 2.26 | 2.26 | 2.02 | 1.57 |
| 450 | 2.43 | 2.32 | 2.40 | 1.87 | 1.73 |
| 500 | 2.38 | 2.32 | 2.50 | 1.97 | 1.68 |
| 550 | 2.36 | 2.32 | 2.47 | 1.89 | 1.64 |

I claim:

1. A dyesheet for use in light-induced thermal transfer printing wherein inducing light is absorbed to provide the thermal energy required for effecting transfer of dye from the dyesheet to a receiver, comprises a substrate having on one side a dyecoat comprising a polymeric binder containing at least one thermal transfer dye dissolved or dispersed therein, and between the dyecoat and the substrate an absorber coat comprising a polymeric binder containing at least one infra-red absorber dissolved or dispersed therein for absorbing the inducing light to provide the thermal transfer energy during printing, the absorber coat binder having a composition different from that of the dyecoat binder and through which the dye molecules diffuse less readily under printing conditions than they do through the dyecoat binder.

2. A dyesheet as claimed in claim 1, characterised in that the absorber comprises carbon black.

3. A dyesheet as claimed in claim 1, characterised in that the absorber comprises an organic material which absorbs light in the near infra-red wave band of 750–900 nm.

4. A dyesheet as claimed in claim 3 wherein the organic material comprises a substituted phthalocyanine dye.

5. A dyesheet as claimed in claim 1, characterised in that the thickness of the substrate is 20–30 μm.

6. A dyesheet as claimed in claim 1, characterised in that the dyecoat binder and the absorber coat binder are both substantially transparent to the inducing light.

7. A dyesheet as claimed in claim 1, characterised in that the dyesheet has a dyecoat surface with an average roughness of less than 0.2 μm.

8. A dyesheet as claimed in claim 7, characterised in that the dyesheet has a dyecoat surface with an average roughness of less than 0.15 μm.

9. A dyesheet as claimed in claim 1, characterised in that the substrate has an elongated ribbon shape, and the dyecoat comprises a plurality of different coloured dyes dispersed in binders to form coloured panels arranged as a repeated sequence along the length of the ribbon, each sequence containing a uniform panel of each colour overlying an absorber coat comprising a polymeric material through which the dye molecules diffuse less readily under printing conditions than they do through the polymeric binder of the dyecoat panel.

10. A dyesheet as claimed in claim 1, characterised in that the absorber coat has a composition which is chemically less compatible with the dyes than is the dyecoat binder.

11. A dyesheet as claimed in claim 1, characterised in that the dyecoat binder is a substantially uncrosslinked polymeric material permeable to the dye molecules, and the polymeric material of the absorber coat comprises a crosslinked organic polymer.

12. A dyesheet as claimed in claim 11 characterised in that the crosslinked material is the reaction product of a solvent-soluble compound having a plurality of reactive hydroxyl groups per molecule, and a crosslinking agent reactive with such hydroxyl groups, the functionality of one of these reactants being at least 2, and the functionality of the other being at least 3, thereby to produce a highly crosslinked polymer matrix.

13. A dyesheet as claimed in claim 12 characterised in that the crosslinking agent is a polyfunctional N-(alkoxymethyl) amine resin having at least three alkoxymethyl groups per molecule which are available to react with the hydroxyl groups of the above solvent-soluble compounds.

14. A dyesheet as claimed in claim 11 characterised in that the binder of the absorber coat comprises crosslinked reaction products of polymerising at least one organic compound having a plurality of radically polymerisable unsaturated groups per molecule.

15. A dyesheet as claimed in claim 14 characterised in that the absorber coat comprises the reaction product of radically polymerising a layer of coating composition having the following constituents:

a) at least one organic compound having a plurality of radically polymerisable unsaturated groups per molecule, and at least one of b and c wherein b) consists of at least one organic compound having a single radically polymerisable unsaturated group per molecule copolymerisable with a and c) consists of at least one linear organic polymer in amount within the range 1–20% by weight of the total amount of the radically polymerisable compounds of constituents a and b.

16. In a process of light-induced thermal transfer printing which comprises pressing a dyesheet into intimate contact with a receiver and subjecting the contacting dyesheet and receiver to light-induced thermal transfer printing wherein inducing light is absorbed to provide the thermal energy required for effecting transfer of dye from the dyesheet to a receiver, the dyesheet being one according to claim 1.

17. In a process of light-induced thermal transfer printing which comprises pressing a dyesheet into intimate contact with a receiver and subjecting the contacting dyesheet and receiver to light-induced thermal transfer printing wherein inducing light is absorbed to provide the thermal energy required for effecting transfer of dye from the dyesheet to a receiver, the dyesheet comprises a substrate having on one side a dyecoat comprising a polymeric binder containing at least one thermal transfer dye dissolved or dispersed therein, and between the dyecoat and the substrate an absorber coat comprising a polymeric binder containing an infra-red absorber for the inducing light to convert it into the required thermal energy, the absorber coat having a composition different from that of the dyecoat binder and through which the dye molecules diffuse less readily under printing conditions than they do through the dyecoat binder.

18. In a process as claimed in claim 17, the improvement wherein the dyesheet and receiver are provided with smooth surfaces which are pressed into intimate contact during printing whereby the dye molecules can diffuse directly from the dyecoat into the receiver when heated.

19. A dyesheet for use in light-induced thermal transfer printing wherein inducing light is absorbed to provide the thermal energy required for effecting transfer of dye from the dyesheet to a receiver, comprises a substrate having on one side a dyecoat comprising a polymeric binder containing at least one thermal transfer dye dissolved or dispersed therein, and between the dyecoat and the substrate an absorber coat comprising a material which is an absorber for the inducing light to convert it into the required thermal energy, characterised in that the absorber coat also comprises a polymeric material which is different from the dyecoat binder and through which the dye molecules diffuse less readily under printing conditions than they do through the dyecoat binder, the dyecoat binder being a substantially uncrosslinked polymeric material permeable to the dye molecules, and the polymeric material of the absorber coat comprising a crosslinked organic polymer, wherein the crosslinked material is the reaction product of a solvent-soluble compound having a plurality of reactive hydroxyl groups per molecule, and a crosslinking agent reactive with such hydroxyl groups, the functionality of one of these reactants being at least 2, and the functionality of the other being at least 3, thereby to produce a highly crosslinked polymer matrix, the crosslinking agent being a polyfunctional N-(alkoxymethyl) amine resin having at least three alkoxymethyl groups per molecule which are available to react with the hydroxyl groups of the above solvent-soluble compounds.

20. A dyesheet for use in light-induced thermal transfer printing wherein inducing light is absorbed to provide the thermal energy required for effecting transfer of dye from the dyesheet to a receiver, comprises a substrate having on one side a dyecoat comprising a polymeric binder containing at least one thermal transfer dye dissolved or dispersed therein, and between the dyecoat and the substrate an absorber coat comprising a material which is an absorber for the inducing light to convert it into the required thermal energy, characterised in that the absorber coat also comprises a polymeric material which is different from the dyecoat binder and through which the dye molecules diffuse less readily under printing conditions than they do through the dyecoat binder, the dyecoat binder being a substantially uncrosslinked polymeric material permeable to the dye molecules, and the polymeric material of the absorber coat comprising a crosslinked organic polymer, said absorber comprising carbon black.

21. A dyesheet for use in light-induced thermal transfer printing wherein inducing light is absorbed to provide the thermal energy required for effecting transfer of dye from the dyesheet to a receiver, comprises a substrate having on one side a dyecoat comprising a polymeric binder containing at least one thermal transfer dye dissolved or dispersed therein, and between the dyecoat and the substrate an absorber coat comprising a material which is an absorber for the inducing light to convert it into the required thermal energy, characterized in that the absorber coat also comprises a polymeric material which is different from the dyecoat binder and through which the dye molecules diffuse less readily under printing conditions than they do through the dyecoat binder, the dyecoat binder being a substantially uncrosslinked polymeric material permeable to the dye molecules, and the polymeric material of the absorber coat comprising a cross-linked organic polymer, wherein the cross-linked material is the reaction product of a solvent-soluble compound having a plurality of reactive hydroxyl groups per molecule, and a cross-linking agent reactive with such hydroxyl groups, the functionality of one of these reactants being at least 2, and the functionality of the other being at least 3, thereby to produce a highly cross-linked polymer matrix, the cross-linking agent being a polyfunctional N-(alkoxymethyl) amine resin having at least three alkoxymethyl groups per molecule which are available to react with the hydroxyl groups of the above solvent-soluble compounds, said absorber comprising an organic material which absorbs light in the near infrared waveband of 750–900 nm.

* * * * *